US006004076A

United States Patent [19]

Cook et al.

[11] Patent Number: 6,004,076

[45] Date of Patent: Dec. 21, 1999

[54] METHOD AND APPARATUS FOR MONITORING SOIL COMPACTION

[75] Inventors: Eric Johnstone Cook, Nigel, South Africa; Aubrey Ralph Berrange, Pinner, United Kingdom

[73] Assignee: Compaction Technology (Soil) Limited, Harrow, United Kingdom

[21] Appl. No.: 08/894,903

[22] PCT Filed: Mar. 1, 1996

[86] PCT No.: PCT/GB96/00489

§ 371 Date: Dec. 23, 1997

§ 102(e) Date: Dec. 23, 1997

[87] PCT Pub. No.: WO96/27713

PCT Pub. Date: Sep. 12, 1996

[30] Foreign Application Priority Data

Mar. 3, 1995 [GB] United Kingdom ..... 9504345

[51] Int. Cl.[6] ..... E02D 3/02; E01C 19/30

[52] U.S. Cl. ..... 405/271; 73/573; 73/579; 318/128; 364/153; 404/117; 404/133.05; 405/303

[58] Field of Search ..... 405/271, 303; 404/117, 133.05; 73/573, 579; 364/153, 528.1; 318/128

[56] References Cited

U.S. PATENT DOCUMENTS

| | | | |
|---|---|---|---|
| 2,897,734 | 8/1959 | Bodine | 405/271 X |
| 2,909,106 | 10/1959 | Berrange . | |
| 3,797,954 | 3/1974 | Harris | 404/117 |
| 3,865,501 | 2/1975 | Kniep | 405/271 X |
| 4,149,253 | 4/1979 | Paar et al. | 364/528.1 X |
| 4,330,738 | 5/1982 | Paramythoiti et al. | 318/128 |
| 4,422,795 | 12/1983 | Berrange . | |
| 4,467,652 | 8/1984 | Thurner et al. | 404/133.05 |
| 4,546,425 | 10/1985 | Breitholtz | 364/153 |
| 4,590,802 | 5/1986 | Furmanski | 73/573 |
| 4,699,546 | 10/1987 | Massarsch | 405/271 |
| 4,712,943 | 12/1987 | Alvarsson | 404/117 X |
| 4,734,846 | 3/1988 | Konig . | |

FOREIGN PATENT DOCUMENTS

| | | |
|---|---|---|
| 2701968 | 9/1994 | France . |
| WO 8 603 237 | 6/1986 | WIPO . |
| WO 9 425 680 | 10/1994 | WIPO . |

*Primary Examiner*—Dennis L. Taylor
*Attorney, Agent, or Firm*—Akin, Gump, Strauss, Hauer & Feld

[57] ABSTRACT

A method of monitoring of the level of compaction of a soil surface undergoing compaction by an impact compactor which includes a rotatable, multi-sided compactor mass that applies periodic impact blows to the soil surface when rolled over that surface. In accordance with the invention, data related to the level of compaction of the soil surface is derived, during compaction of the soil surface, from the deceleration of the compactor mass as it impacts the soil surface. This is achieved using one or more accelerometers mounted on the impact compactor.

11 Claims, 3 Drawing Sheets

METHOD AND APPARATUS FOR MONITORING SOIL COMPACTION

BACKGROUND TO THE INVENTION

This invention relates to the monitoring of soil compaction using a compaction machine which applies periodic impact blows to the soil surface.

In one application of the invention, it is applicable to the monitoring of soil compaction by an impact compactor. The term "impact compactor", as used initially in U.S. Pat. No. 2,909,106, refers to a soil compaction machine which incorporates an out-of-round mass which produces a series of impact blows to the soil surface when towed or otherwise driven over that surface. The compactor mass of an impact compactor has multiple sides defining a series of spaced apart salient points on its periphery, each salient point being followed by a compacting face. As the impact roller is towed or moved over the soil surface, it rises up on each salient point and then falls forwardly and downwardly as it passes over that point, with the result that the following compacting face applies an impact blow to the soil surface. The action of the mass is therefore to store potential energy as it rises up on each salient point and then to deliver this energy as an impact blow.

Impact compactors as described above have been found to work well in practice in achieving high levels of soil compaction, even at substantial depths below the soil surface. However a problem which is encountered during compaction of a site is that of non-uniformity of soil and other conditions over the site, leading to non-uniform compaction over the site.

SUMMARY OF THE INVENTION

According to a first aspect of the invention there is provided a method of monitoring the level of compaction of a soil surface undergoing compaction by means of a impact compactor which includes at least one rotatable, multi-sided compactor mass which applies periodic impact blows to the soil surface when rolled over that surface, wherein data related to the level of compaction of the soil surface is derived, during compaction of the soil surface, from the deceleration of the compactor mass as it impacts the soil surface.

The method preferably includes the step of monitoring the deceleration of the compactor mass by means of at least one accelerometer mounted on the impact compactor in such a position as to undergo movements corresponding to those of the compactor mass.

Preferably also, the method comprises visibly displaying information related to the level of compaction of the soil surface as the compactor mass is rolled over the soil surface. The information may, for instance, be displayed to the operator of the impact compactor. Alternatively or in addition, the information may be displayed at a location remote from the impact compactor.

In the preferred embodiment of the invention data related to the level of compaction of the soil surface is automatically correlated with data related to the geographical position of the impact compactor, the latter data typically being obtained with the use of a global positioning system. With such an arrangement it is possible for a site engineer to obtain full information, during compaction, showing the state of compaction of a soil surface across the compaction site. Accuracy in compacting the site can also be obtained with a refinement of the method in which a visible display is generated to indicate to the operator of the impact compactor whether the movement of the impact compactor on a compaction site is in accordance with predetermined criteria. In response to this display, the operator is continuously in a position during compaction to alter the course of the impact compactor to conform to the predetermined criteria, typically a pre-programmed grid pattern covering the site.

Data related to the level of compaction of the soil surface may be continuously logged in a data logger for the purposes of later downloading such information after compaction of the soil surface.

According to another aspect of the invention there is provided a soil compaction apparatus comprising:

- an impact compactor including at least one rotatable, multi-sided compactor mass shaped to apply periodic impact blows to the soil surface when rolled over that surface;
- means for causing the compactor mass to roll over the soil surface;
- means for monitoring the deceleration of the mass as it applies impact blows to the soil surface; and
- means which operates, during compaction, to derive data related to the level of compaction of the soil surface from the deceleration of the compactor mass as it applies such impact blows.

In the preferred apparatus at least one accelerometer is mounted on the impact compactor for monitoring the deceleration of the compactor mass as it applies impact blows to the soil surface. The, or each, accelerometer is conveniently mounted on an axle to which the compactor mass is connected.

The compactor mass will usually have a plurality of spaced apart, peripheral, salient points and a corresponding number of compacting faces located on the periphery of the mass between the salient points, the arrangement being such that, when rolled over the soil surface, the compactor mass alternately rises up on a salient point and then falls downwardly for the next succeeding compacting face to apply an impact blow to the soil surface, an accelerometer being provided for each compacting face of the compactor mass. For accuracy, the accelerometers are orientated so as to be sensitive to deceleration of the compactor mass in a direction transverse to the associated compacting face.

The apparatus includes electronic processing means for processing signals which are received from the, or each, accelerometer and which are related to the deceleration of the compactor mass as it applies impact blows to the soil surface, and for deriving from such signals values related to the level of compaction of the soil surface. Means are preferably also included for displaying information related to the level of compaction of the soil surface to an operator of the impact compactor and/or at a location remote from the impact compactor.

More sophisticated embodiments of the invention will comprise a global positioning system arranged to produce data related to the geographical position of the impact compactor and for inputting such data to the electronic processing means. In such cases, the electronic processing means is arranged to correlate data related to the level of compaction of the soil surface with data related to the geographical position of the impact compactor, thereby to produce, for a compaction site, information relevant to the level of compaction of the soil surface at different locations on the site.

BRIEF DESCRIPTION OF THE DRAWING

The invention will now be described in more detail, by way of example only, with reference to the accompanying drawings in which.

DESCRIPTION OF EMBODIMENTS

Figure 1:
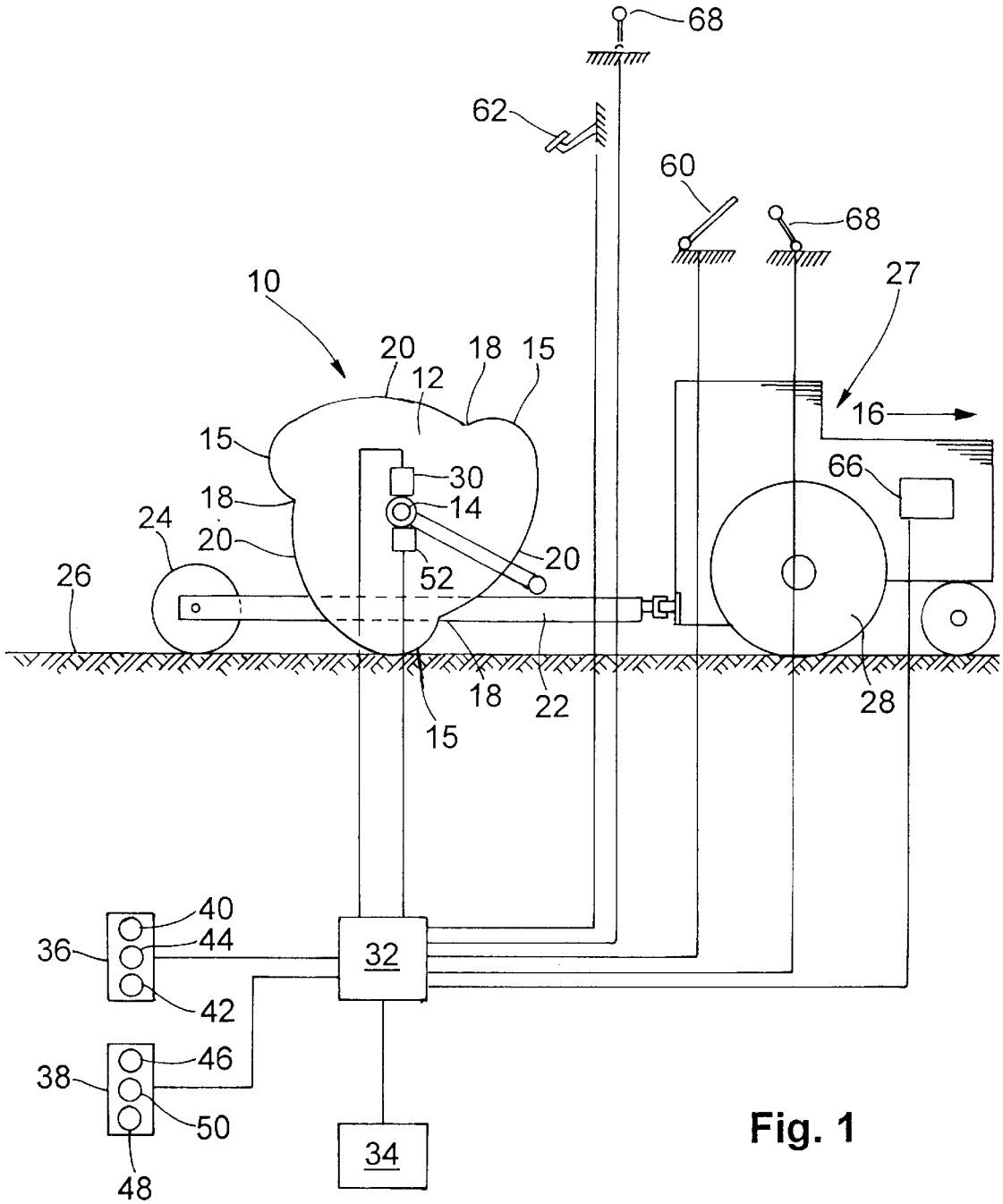
FIG. 1 diagrammatically illustrates an impact compactor according to the invention.

In the diagrammatic illustration of FIG. 1, the numeral 10 generally indicates an impact compactor according to the invention. The impact compactor 10 is largely conventional and may be conventional and may be taken to be a dual mass impact compactor of the type described in U.S. Pat. No. 4,422,795 to Berrange. Only one of the compactor masses, indicated by the numeral 12, is visible in the drawing, and the numeral 14 indicates the axle which connects the masses to one another and causes them to rotate in unison.

As illustrated, each compactor mass 12 is a three-sided mass with three salient points 15 each followed, in the direction of rotation when the impact compactor moves in the forward direction indicated by the arrow 16, by a re-entrant formation 18. Each of the re-entrant formations is followed in turn by a compacting face 20. The compactor masses 12 are carried by a chassis 22 mounted on road wheels 24, only one of which is visible. The chassis and compactor masses are towed over the soil surface 26 which is to be compacted by means of a tractor or integral driving unit 27, a drive wheel of which is indicated by the numeral 28.

In operation, the assembly of chassis and compactor masses is towed over the soil surface 26 according to a predetermined compaction pattern. During this movement, the compactor masses alternately rise up on their salient points 15 and then fall forwardly for their compacting faces 20 to apply impact blows to the soil surface. At each impact, the potential energy which is stored as the masses rise up is delivered to the soil surface, with the result that the soil is compacted. The energy available for compaction at each blow is dependent on the mass and geometry of the compactor mass.

In most cases the impact compactor will be caused to traverse the compaction site on a number of passes to achieve adequate compaction of the soil. The level of compaction has conventionally been measured by in situ tests conducted at selected locations over the site after a number of passes has taken place. If the tests indicated under-compaction in some locations, the impact compactor undertakes further passes until the tests indicate that the desired level of compaction has been achieved.

However, even with regular tests it has traditionally been difficult to achieve uniform compaction over the entire site because of local variations in soil conditions and content, surface layer thickness, moisture content and other natural factors which affect the compactibility of the soil. Thus the situation may arise that small, untested areas of the site remain inadequately compacted, with possibly disastrous consequences for sections of a road or building construction subsequently erected on those areas.

The present invention addresses this problem by monitoring the level of compaction of the soil surface as the compaction is actually under way. The density of a soil mass gives a measure of the compaction of the soil, and it is known that the density of a soil mass is related to its elastic resilience or modulus. In turn, the resilience or elastic modulus of the soil affects the deceleration of a mass caused to impact on the soil surface, i.e. the more resilient the surface, the less the deceleration and vice versa. The invention uses these relationships to provide an indication of the level of compaction of the soil, as described below.

Mounted on the casing of the axle 14 is an accelerometer 30 orientated to measure rates of change of velocity of the axle in the vertical sense. The accelerometer is accordingly sensitive to vertical accelerations and decelerations of the compactor masses which are connected to the axle. The output of the accelerometer is fed to an electronic processor 32 mounted on board the impact compactor, possibly in the operator's cab. Signals related to the deceleration of the compactor masses 12 at each impact on the soil surface 26 are processed by the processor which derives from those signals values for the soil density. The processor derives a peak deceleration value from a batch of, say, five to ten impacts, and computes a value for soil density for each such batch. Soil density values are then stored in a data storage unit or data logger 34 linked to the processor.

In addition, the processor 32 is arranged to drive visible indicator units 36 and 38. The unit 36 is mounted on top of the operator's cab and includes a bank of lights consisting of a red light 40, a green light 42 and an amber light 44 which will be visible to an observer viewing the operation of the impact compactor from an external, remote position. The unit 38 is mounted inside the operator's cab where it will be visible to the operator, and similarly includes a bank uf red, green and amber lights 46, 48 and 50 respectively.

Before compaction of a site commences, a site engineer or other person in charge of the compaction operation presets the processor 32, typically by means of preset dials. The engineer may, for instance, wish to achieve a level of compaction, i.e. a soil density, which corresponds to a deceleration value of, say, 15G, i.e. fifteen times the gravitational acceleration constant. He therefore presets the processor with a desired upper compaction level of 15G.

If, during compaction, a situation of zero air voids in a soil mass is reached, this indicates that the interstices between the individual soil particles are filled with moisture. The soil mass effectively becomes a highly unstable, fluidised mass subject to horizontal shearing, and further compaction of the mass will serve no purpose. At the same time, such a soil mass will give very low deceleration values because of the instability of the soil and horizontal shearing. With a view to avoiding attempts further to compact a soil mass in this condition, the site engineer will also preset the processor 32 with a lower compaction value, say 7G.

With these exemplary preset values, for all instantaneous compaction levels giving readings between 7G and 15G, the green lights 42 and 48 will be illuminated, indicating both to the remote observer and to the operator of the impact compactor that compaction should proceed. Thus as compaction passes over the site are undertaken, illumination of the green lights constantly indicates that an inadequate level of compaction has been achieved and that further compaction passes are required.

As soon as the processor determines that an adequate level of compaction has been attained, i.e. a level corresponding to the preset value of 15G, the green lights are extinguished and the amber lights 44 and 50 are illuminated, indicating to the observer and operator that compaction of that particular region can be terminated and that attention can be transferred to the next region of the site which is to undergo compaction. While an excessive level of compaction, resulting from further compaction passes while the amber lights are illuminated, is not necessarily undesirable from a structural point of view, it represents a considerable wastage of time and expense.

If the processor detects deceleration values less than 7G, this is an indication that the soil has reached a condition of zero air voids and that further compaction is pointless. The red lights 40 and 46 are illuminated to indicate that the operator must abandon further attempts to compact the area in question and that special soil treatment measures may have to be undertaken in that area.

The output of the processor is continuously logged in the data logger 34 for the purposes of later downloading the data to obtain an indication of the overall state of compaction of the site.

In addition to logging density-related data in the data logger 34, the processor 32 may also derive and log data relating to the velocity of the impact compactor over the soil surface. Minor variations in velocity are not expected to have any substantial effect on the density-related data but it is expected that major variations in velocity could affect the accuracy of that data. It is therefore considered desirable during compaction to maintain the operating speed of the impact compactor within preset limits. For this purpose a magnetic pickup 52 monitors the speed of rotation of the axle 14 and inputs relevant signals to the processor. The processor derives data related to the velocity of the impact compactor from the input signals.

As an alternative to the measurement of ground velocity using a pickup on the axle 14, it would also be possible to use a tachometer on the road wheels 24 or 28 although account would have to be taken, in the case of the wheel 28, of possible wheel slippage. As yet another alternative, a measurement of velocity can be derived from the frequency of the impact blows applied to the soil surface by the compactor masses. In the monitoring of G-values, the impacts applied by the compactor masses will be recognisable as sharp pulses.

With velocity-related data as well as data related to the level of compaction, it is possible for the processor also to have a measure of control over the operation of the impact compactor. As illustrated diagrammatically, the processor may be arranged to control the velocity of the vehicle by controlling the depression of the foot throttle 60 or the depression of the foot brake 62, in each case via a suitable interface. It may also control the setting of the park brake 64. Alternatively or in addition, the processor may control the velocity, as a function of engine speed, through a governor 62, and the position of the gear selection lever 64.

The processor can also be arranged to shut down the engine if an adequate level of compaction has been achieved, thereby preventing wasteful over-compaction. Engine shut-down may also be implemented where the processor detects a condition of zero air voids in the soil, or an excessively low deceleration value, as discussed above.

From initial knowledge about the position of the impact compactor and the input values related to the angular velocity of the axle 14, which are in turn related to the ground speed of the impact compactor, the processor is also able to compute the geographical position of the impact compactor and to correlate this data with the soil density data derived from the analysis of the accelerometer output. Thus the data which is logged in the data logger 34 can be used to relate soil density to geographical position on the site. This will usually require that the impact compactor work in a predetermined grid pattern on the site from a known datum. In this case, the full matrix of site compaction data which is stored by the data storage unit will be of considerable benefit to structural engineers concerned with the design of structures to be erected on the site.

The accumulated data will also be useful in pinpointing possible localities on the site where particularly poor soil conditions or other factors have prevented adequate levels of compaction from being achieved, and hence in indicating where specialised soil treatment may be required.

In more sophisticated versions of the invention data related to geographical position can be obtained with the use of a GPS (global positioning system) on the impact compactor. In such cases, the GPS outputs signals related to the absolute geographical position of the impact compactor on the site.

The processor is described above as deriving values for soil density from the deceleration or G-values output by the accelerometer. In some cases it is believed that a more accurate measure of the level of soil compaction and accordingly a more meaningful item of information for structural engineers, will be the elastic modulus of the soil, derived directly from the deceleration or G-values produced by the accelerometer. The processor may therefore be programmed to output to the data logger a matrix of values correlating site position to elastic modulus rather than soil density. Alternatively the matrix of values may merely correlate G-value with geographical site position.

In each case, the average of deceleration values for a number of impact blows or the peak deceleration value over a number of impact blows may be employed by the processor in its computations.

An advantage of the invention as described above is the facility for a remote observer to monitor the progress of the compaction operation. Thus a site engineer situated in a remote site office may, merely by periodically watching the impact compactor, ensure that soil compaction is progressing in the proper manner. Alternatively he may, by means of appropriate telemetry, monitor the status of the compaction procedure from a remote position without having sight of the impact compactor.

Figure 2:
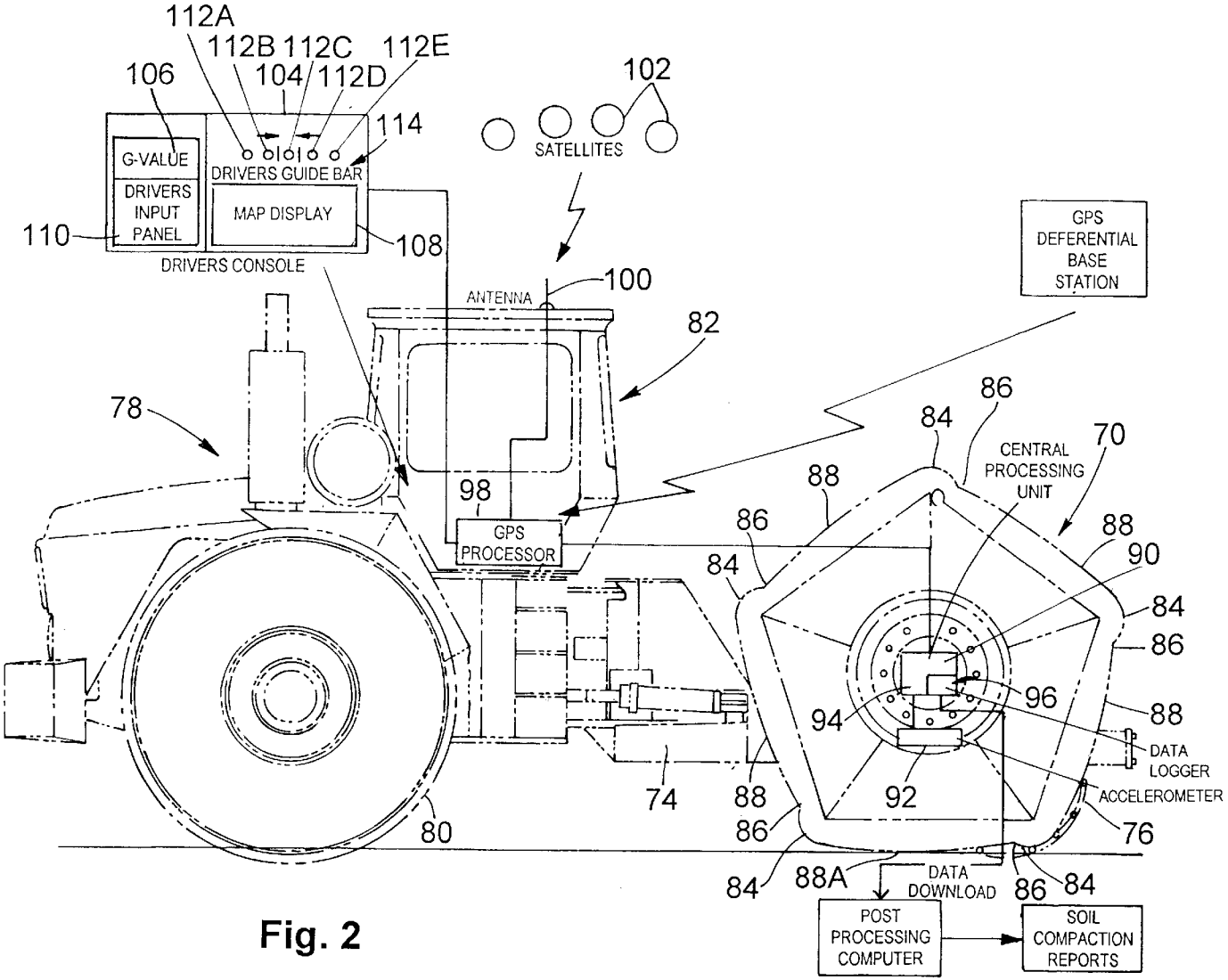
FIG. 2 illustrates a preferred embodiment of the invention.
Figure 3:
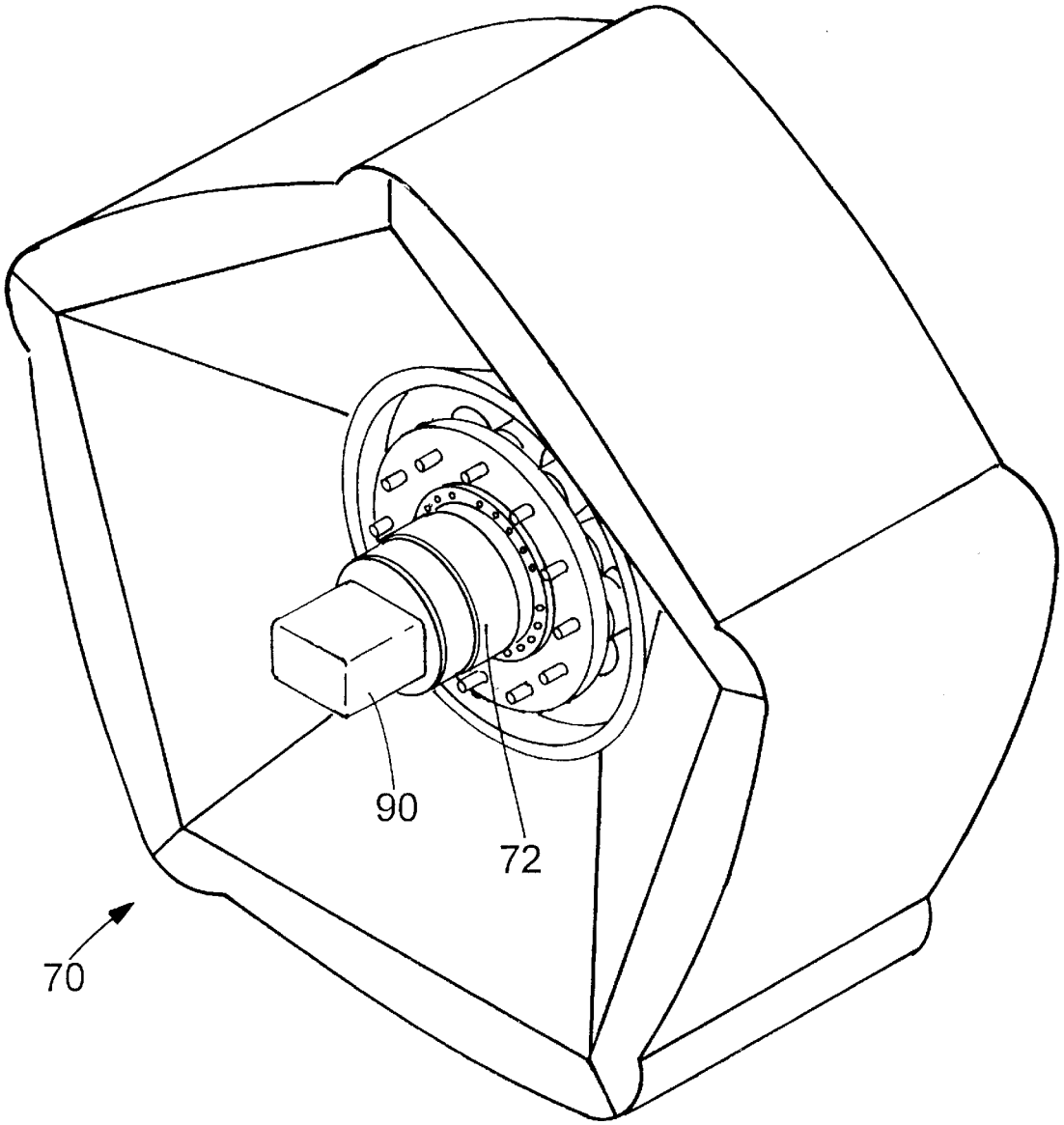
FIG. 3 shows a perspective view of a single compactor mass as used in the preferred embodiment illustrated in FIG. 2.

FIGS. 2 and 3 illustrate a currently preferred embodiment of the invention. These Figures show an impact compaction machine, once again in the form of an impact compactor, which employs side-by-side compactor masses 70 (only one visible) mounted on a common axle 72 supported by a chassis 74 mounted on wheels 76. The chassis is connected to an integral self-propulsion unit 78 which has road wheels 80 and a driver's cab 82. The illustrated compactor mass 70 is a five-sided mass, with salient points 84, re-entrant formations 86 and compacting faces 88.

The embodiment of FIGS. 2 and 3 includes, for at least one of the compactor masses 70, a data acquisition and processing unit 90. Referring to FIG. 3, it will be seen that the unit 90 is mounted on the outboard end of the axle 72.

The data acquisition and processing unit 90 incorporates a series of five accelerometers 92. Each of the accelerometers is orientated so as to sense deceleration in a direction generally at right angles to one of the compacting faces 76. For clarity of illustration, only of the accelerometers 92 is shown in FIG. 2, the illustrated accelerometer being sensitive to vertical deceleration of the compactor mass 70 as a result of an impact applied to the soil surface by the compacting face designated 88A.

In addition to the five accelerometers, the data acquisition and processing unit 90 also incorporates a processing unit 94 and a data logger 96 corresponding respectively to the processing unit 32 and data logger 34 in FIG. 1. The processing unit 94 receives signals from the five accelerometers during compaction of a soil surface and derives from those signals values for G-value, for elastic modulus of the soil or for soil density, as described above in connection with FIG. 1.

The processing unit 94 also receives data related to the geographical position of the impact compactor from a GPS processor 98 mounted on the propulsion unit 78. As indicated diagrammatically, the GPS processor 98 is connected to an aerial 100 on the driver's cab 82 receiving appropriate satellite data from overhead satellites 102. Thus, as in the first embodiment described with reference to FIG. 1, the processing unit is able, on the basis of the data which it receives from the respective accelerometers 92 and from the GPS processor 98, to correlate site compaction information with geographical position information. Computed data from the processor 94 is continuously logged by the data logger 96 for later downloading.

A control panel 104 is mounted in the driver's cab 82. The control panel includes its own processing unit and incorporates an instantaneous G-value readout 106 from which the driver or operator of the impact compactor can determine the instantaneous G-value at each position on the site as that position is traversed. Of course, in cases where soil density or elastic modulus is computed instead of G-value, the read-out provided to the operator is modified accordingly. In addition to this on-site read-out of the relevant value indicating the state of compaction of the soil, there may be panel(s), similar in nature and function to the panel 36 and/or 38 described above, to indicate the state of compaction to the driver and/or to a remote observer. As also described previously, the state of compaction of the soil may be also be transmitted to a remote location by appropriate telemetry.

The control panel in FIG. 2 also includes a map display unit 108 on which is displayed a graphical representation of the site undergoing compaction. The data necessary to form the map display may be input separately, at the commencement of a compaction exercise, by means of an input panel 110 included in the control panel 104.

As illustrated, the control panel 104 also incorporates a series of five lights 112A to 112E arranged in a horizontal line and forming a guide bar indicated generally with the numeral 114. In a typical compaction exercise, the impact compactor will be required to traverse the site in accordance with an accurate grid of predetermined, straight line passes. If the impact compactor is moving correctly along a given grid line, as determined from the input of the GPS processor, the central guide bar light 112C, typically coloured green, is illuminated. If the impact compactor deviates slightly from the predetermined grid line, one or other of the guide bar lights 112B or 112D, typically amber in colour, is illuminated, thereby providing the operator with a visual indication that he has deviated from the required path and at the same time telling him whether the deviation is to the left or the right of the required path. In this situation, the operator is able to steer the impact compactor onto the correct path in accordance with the predetermined grid. If there is a marked deviation from the required path one or other of the outermost guide bar lights 112A or 112E, typically red in colour, is illuminated to indicate the incorrect path taken by the impact compactor and also showing whether the deviation is to the left or the right of the correct path.

In addition to the guide bar lights, deviation from the correct path may also be indicated audibly by suitable sound generating devices such as buzzers or the like.

In response to signals received from the GPS processor the map display in the driver's cab will also typically give a visual indication of the position of the impact compactor on the graphically represented site.

Although not illustrated in FIG. 2, the various control options such as velocity control, engine speed control, brake control and the like may also be included in this embodiment.

It will be appreciated that the data acquisition and processing unit 90, mounted directly on the compactor mass axle, must be reasonably robust to withstand the shock loading to which it is subjected in use. In this case, because of potential difficulty in providing hard-wired connections the unit 90 may also include a suitable transceiver to transmit and receive relevant signals to and from associated apparatus.

In practice, a data acquisition and processing unit 90 can be provided for each compactor mass so as to provide accurate site data for both tracks traversed by the compactor masses.

We claim:

1. A method of monitoring a level of compaction of a soil surface undergoing compaction by an impact compactors which includes the steps of:

applying a plurality of impact blows, in a periodic manner, to the soil surface using at least one compactor mass having a multi-sided shape, the at least one compactor mass applying the plurality of impact blows to the soil surface while rotating on the soil surface, generating a plurality of data representing a deceleration of the at least one compactor mass as a portion of the at least one compactor mass impacts the soil surface while delivering each of the plurality of impact blows:

collecting the plurality of data related to the level of compaction of the soil surface as the at least one compactor mass rotates over the soil surface applying the plurality of impact blows on the soil surface.

2. A method according to claim 1, further comprising the step of:

monitoring the deceleration of the at least one compactor mass via at least one accelerometer mounted on the impact compactor to undergo movements that correspond to those of the at least one compactor mass.

3. A method according to claim 1, further comprising the step of:

displaying information, in a visual fashion, related to the level of compaction of the soil surface as the at least one compactor mass is rotating on the soil surface.

4. A method according to claim 3, further comprising the step of:

displaying information related to the level of compaction of the soil surface to an operator of the impact compactor.

5. A method according to claim 3, further comprising the step of:

displaying information related to the level of compaction of the soil surface at a location remote from the impact compactor.

6. A method according to claim 1, further comprising the step of:

correlating the plurality of data related to the level of compaction of the soil surface with a second plurality of data related to a geographical position of the impact compactor.

7. A method according to claim 6, further comprising the step of:

receiving the second plurality of data related to the geographical position of the impact compactor via a global positioning system.

8. A method according to claim 6, further comprising the step of:

signaling, in a visible fashion, an operator of the impact compactor to indicate whether the movement of the impact compactor on a compaction site is in accordance with predetermined criteria.

9. A method according to claim 1, further comprising the step of:

monitoring a velocity of the impact compactor as the at least one compactor mass rolls over the soil surface.

10. A method according to claim 9, further comprising the steps of:

correlating a third plurality of data related to the velocity of the impact compactor with the plurality of data related to the level of compaction of the soil surface.

11. A method according to claim 1, further comprising the steps of:

storing the plurality of data related to the level of compaction of the soil surface in a data storage device; and retrieving the plurality of data after compaction of the soil surface.

* * * * *